US006082825A

United States Patent [19]

Simon

[11] Patent Number: 6,082,825

[45] Date of Patent: Jul. 4, 2000

[54] SEATING SUSPENSION ASSEMBLY

[75] Inventor: Bernard Simon, Whitsett, N.C.

[73] Assignee: L&P Property Management Company, South Gate, Calif.

[21] Appl. No.: 09/397,376

[22] Filed: Sep. 16, 1999

Related U.S. Application Data

[63] Continuation-in-part of application No. 09/241,962, Feb. 2, 1999.

[51] Int. Cl.[7] ..... A47C 7/34

[52] U.S. Cl. ..... 297/452.63; 297/452.5; 5/720; 267/101

[58] Field of Search ..... 297/452.5, 452.63, 297/452.51, 452.56; 267/91, 95, 101; 5/720

[56] References Cited

U.S. PATENT DOCUMENTS

| | | | |
|---|---|---|---|
| 911,201 | 2/1909 | Budd . | |
| 919,201 | 4/1909 | Montgomery | 267/91 |
| 1,815,510 | 7/1931 | Hotter . | |
| 1,876,101 | 9/1932 | Thum . | |
| 1,899,726 | 2/1933 | Rusnak . | |
| 2,013,573 | 9/1935 | McNally . | |
| 2,042,763 | 6/1936 | Bernstein . | |
| 2,052,811 | 9/1936 | Suekoff | 267/95 |
| 2,055,213 | 9/1936 | Bernstein . | |
| 2,849,057 | 8/1958 | Neely . | |
| 2,936,027 | 5/1960 | Simon | 267/91 |
| 3,160,894 | 12/1964 | Frey | 5/720 |
| 3,165,308 | 1/1965 | Rathbun . | |
| 3,462,779 | 8/1969 | Thompson . | |
| 3,649,077 | 3/1972 | Flint . | |
| 4,303,232 | 12/1981 | Crosby . | |
| 4,458,943 | 7/1984 | Krakauer . | |
| 4,819,920 | 4/1989 | Barber . | |
| 4,903,949 | 2/1990 | Schulz, Jr. . | |
| 5,165,667 | 11/1992 | Dabney . | |
| 5,188,343 | 2/1993 | Galea . | |
| 5,238,514 | 8/1993 | Tornero . | |
| 5,393,596 | 2/1995 | Tornero et al. . | |
| 5,424,110 | 6/1995 | Tornero et al. . | |
| 5,468,048 | 11/1995 | Clemens et al. . | |
| 5,570,874 | 11/1996 | Tornero | 297/452.63 |
| 5,700,060 | 12/1997 | Bullard et al. | 297/452.5 |
| 5,957,438 | 9/1999 | Workman et al. | 5/720 |

FOREIGN PATENT DOCUMENTS

| | | |
|---|---|---|
| 10904/27 | 10/1928 | Australia . |
| 104704 | 8/1938 | Australia . |
| 1065252 | 1/1984 | Russian Federation . |
| 494763 | 11/1938 | United Kingdom . |

OTHER PUBLICATIONS

Ultraflex, *Ultra–Flex Elastic Webbing And Drop–in Coil Springs* . . . , Ultraflex advertisement in UDM Upholstery Design & Manufacturing (Feb. 1996).

*Primary Examiner*—Peter R. Brown
*Attorney, Agent, or Firm*—Wood, Herron & Evans, LLP

[57] ABSTRACT

A suspension assembly for use in a chair or sofa seat having a top strap secured to a bottom strap forming a pocket into which a rigid frame is inserted. In a first preferred embodiment, the rigid frame biases the straps both together and longitudinally towards the pocket ends. In a second preferred embodiment, the rigid frame biases the straps both open and longitudinally towards the pocket ends. Springs are inserted into the pocket to continually bias the pocket open. The opposing biasing forces of the frame and the springs form a pretensioned suspension assembly that may be installed in seating applications without further stretching of the assembly during installation in a chair or sofa frame.

18 Claims, 5 Drawing Sheets

SEATING SUSPENSION ASSEMBLY

CROSS REFERENCE

The present application is a continuation-in-part of copending U.S. Ser. No. 09/241,962, filed on Feb. 2, 1999, the disclosure of which is hereby incorporated herein in its entirety.

FIELD OF THE INVENTION

The invention relates to seating assemblies. More specifically, this invention relates to a pre-stretched resilient seating assembly.

BACKGROUND OF THE INVENTION

Furniture manufacturers have improved their products' manufacturing techniques through the years in an attempt to provide customers with comfortable, durable and reasonably priced upholstered furniture. Metal coil and sinuous springs have been used for many years in chair and sofa frames to the satisfaction of the purchasers. However, as labor costs have sharply risen, manufacturers are turning to a variety of different constructions, some of which utilize fabric straps and webbings in place of the usual metal springs as in the assignee's own U.S. Pat. No. 5,700,060. Certain decking or suspension fabrics have been well accepted whereas others have been either too stiff or too compliant for widespread acceptance. Also, prior spring assemblies for furniture seating of the all metal type are heavy, making handling and shipping, and installation difficult and expensive.

While more modern assemblies are lighter to ship, they lack a degree of structural rigidity that heavier assemblies previously had, still can be difficult to install on a seating frame and often cause stress on the seating frame during installation, thereby, reducing the useful life of the seating frame.

OBJECTIVES OF THE INVENTION

It is therefore an object of the present invention to provide a lightweight suspension assembly which has rigidity normally associated with heavier assemblies.

It is a further objective of the present invention to provide a seating assembly that is lightweight and rigid but low in cost to manufacture and install.

It is another object of the present invention to provide a lightweight suspension assembly that is easier to install on a seating frame and reduces frame stress during installation.

Still another objective of this invention has been to improve the seating assembly of the assignee's own U.S. Pat. No. 5,700,060, thereby making that assembly easier to install, less stressful on the seating frame in which it is installed, and overall, less costly to the seating manufacturer.

SUMMARY OF THE INVENTION

The preceding objectives are accomplished with the present seating suspension assembly that has a substantially rectangular metal frame inserted into a strap pocket to both pretension and add lateral rigidity to the seating assembly.

The improved seating assembly has a top strap and a bottom strap affixed at their respective ends to form a pocket therebetween. Resilient members, such as non-tensioned or pretensioned coil springs, a bent wire form, a fibrous bat or a polymeric foam are contained within the pocket to resiliently expand the bottom strap away from the top strap. Either prior to or subsequent to insertion of the resilient members, a substantially rectangular frame as long as the pocket is wide is placed into the pocket formed by the top and bottom straps in order to pretension the pocket, i.e., bias it longitudinally. Thereby, during and after the resilient members are inserted into the pocket, the rectangular frame continues to stretch the pocket along its longitudinal extent.

An individual pre-stretched suspension assembly is attached with staples or the like to a furniture frame. Thereafter, fabric coverings, paddings or decorative fabrics can be placed on the furniture frame for supporting seat cushions on chairs, sofas and the like. Because the suspension assembly is pre-stretched by the metal frame prior to installation, the suspension assembly does not need to be stretched during installation, thereby, reducing frame stress. Also, because the suspension assembly is pre-stretched, no equipment is needed to stretch the suspension assembly during installation, thereby reducing installation costs.

In addition to the stress relief on the frame and the ease of installation provided by the invention of this application, the suspension assembly of this invention adds lateral stability to the resulting upholstered seat created using the frame. Additionally, because the metal frame may be placed face-up or face-down upon installation of the suspension assembly in the chair frame, as much as twenty percent difference may be obtained in the load bearing deflection characteristics of the seat created using this suspension assembly.

DETAILED DESCRIPTION OF THE PREFERRED EMBODIMENT

The suspension assembly of U.S. Pat. No. 5,700,060, upon which the invention of this application is an improvement, is hereby incorporated in its entirety by reference.

Figure 1:
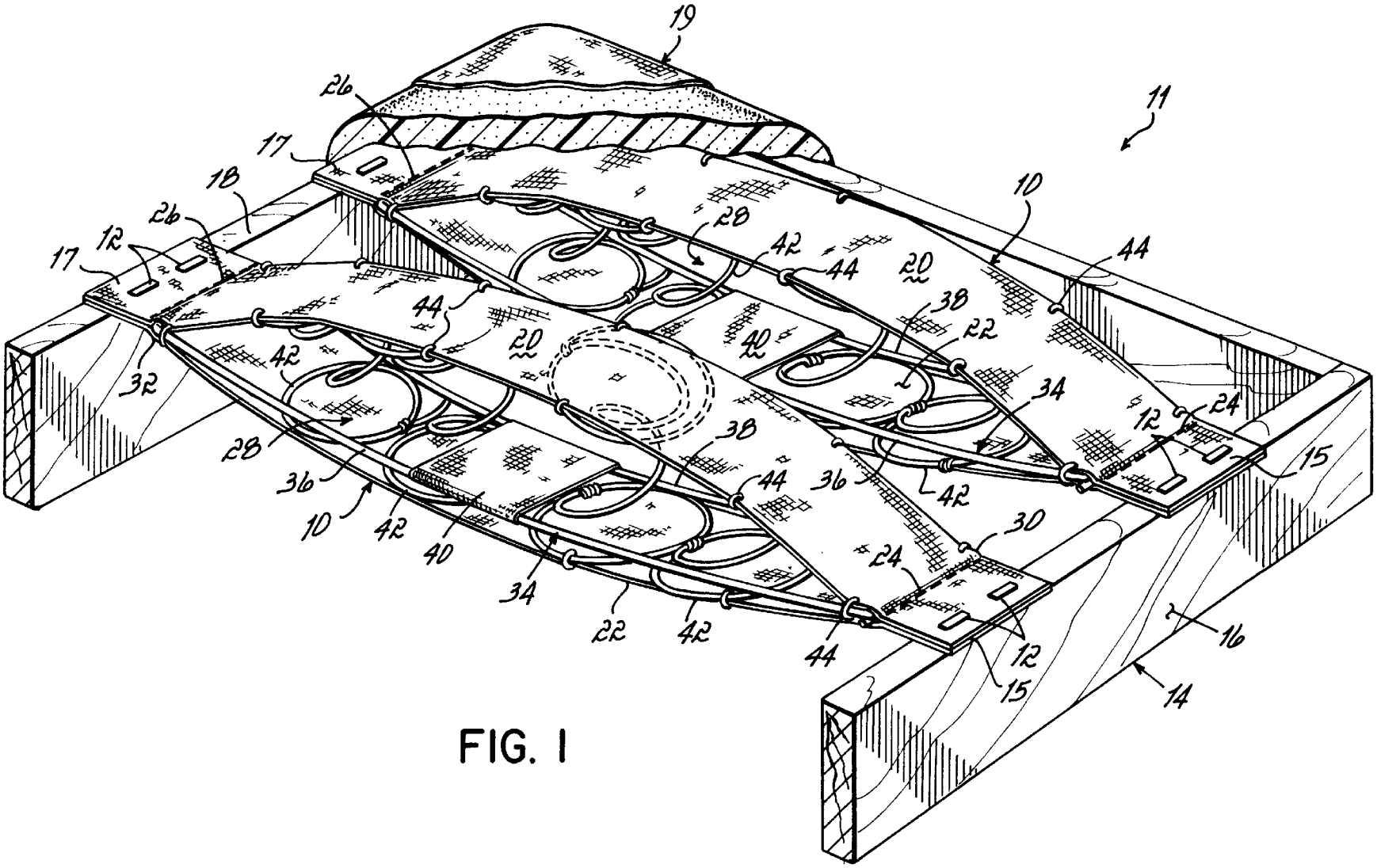
FIG. 1 is a perspective view of a partial seating frame with suspension assemblies according to the present invention affixed thereto.
Figure 2:
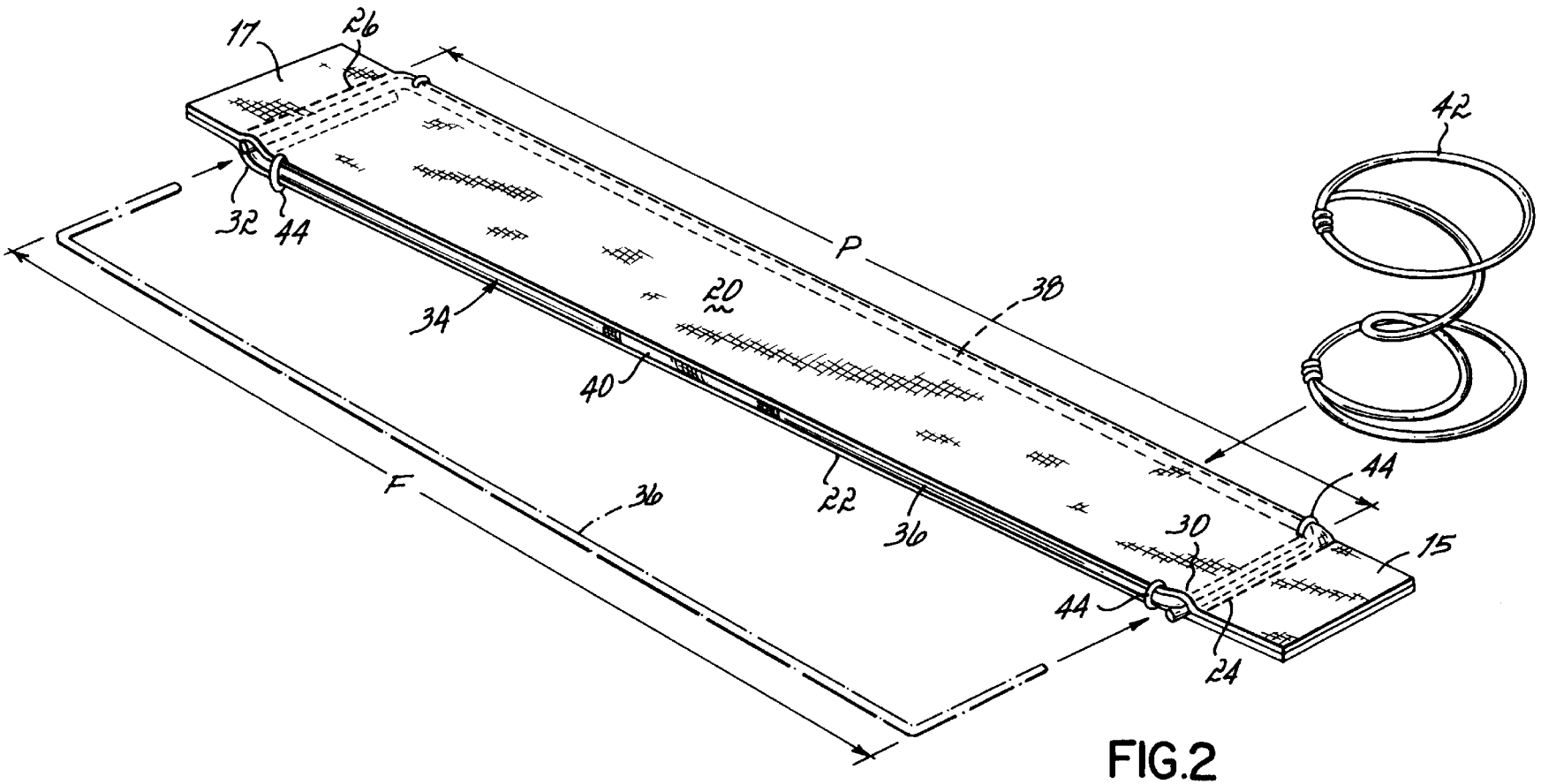
FIG. 2 is a partial exploded perspective view of the suspension assembly of the present invention.
Figure 3:
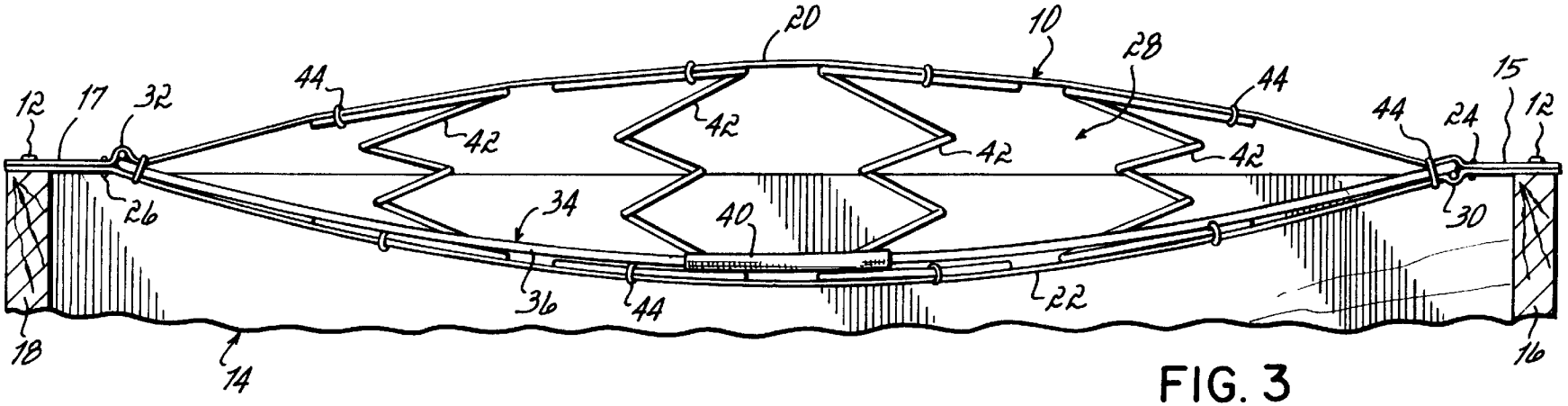
FIG. 3 is a cross-sectional view of the suspension assembly of FIG. 1 taken along lines 3—3.
Figure 4:
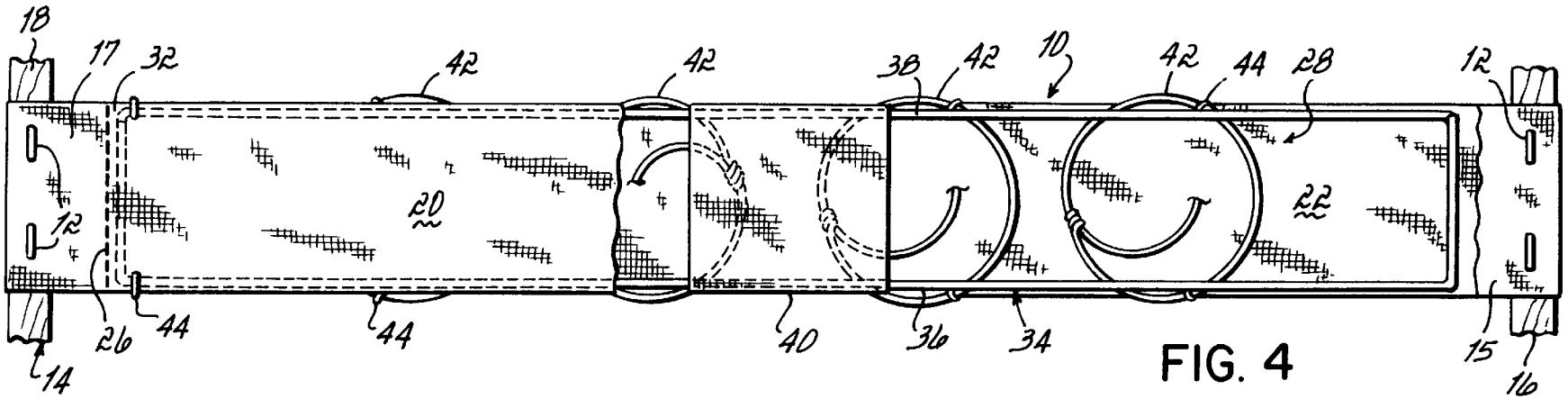
FIG. 4 is a top plan, partially cut away view of the suspension assembly of the present invention.

As can be seen in FIG. 1, of the present application a suspension assembly 10 is attached near its front and rear ends 15, 17 with fasteners, e.g., staples 12, to a seating frame 14 such as couch, sofa, or chair frame having first and second spaced components, e.g., a front rail 16 and a rear rail 18. Once attached to the seating frame 14, the suspension assembly 10 may be covered with padding and upholstery 19 or other material known in the art to form a seating assembly 11.

The suspension assembly 10 has a top fabric strap or web 20 and a bottom fabric strap or web 22 attached together with lines of stitching 24, 26 to define a pocket 28 with a front end crease 30 and a rear end crease 32, as seen in FIGS. 1–4. The pocket 28 has a length P which may be varied depending on factors such as the width the suspension assembly 10 is intended to span, and the amount of resiliency the suspension assembly 10 is intended to provide to a user. It will be understood by those in the art that the top strap 20 and the bottom strap 22 may be attached together by sewing or any other suitable means known in the art.

A frame 34 having a length F is inserted into the pocket 28. The length F of the frame 34 is substantially coextensive with the length P of the pocket 28 so that the pocket 28 is continually biased along its longitudinal extent towards pocket creases or sew lines 30, 32. The frame 34, in a first preferred embodiment, has a pair of oppositely disposed substantially planar U-shaped metal bars or wire rods 36, 38 which are tied together in fixed relation to each other with a tie strap 40. As will be understood by those in the art, the frame 34 may take on various different configurations in order to continually bias the pocket 28 towards pocket creases 30, 32. In the preferred embodiment, the metal bars 36, 38 are six gauge solid metal wire, but it will be understood by those in the art that the frame 34 may use any material that is rigid enough to bias the pocket 28 towards the end creases 30, 32 while withstanding forces exerted upon it from extended use.

By biasing the pocket 28 towards ends 30, 32, the frame 34 pretensions the pocket 28 closed before inserting resilient material, e.g., coil springs 42 that then push the top strap 20 and the bottom strap 22 away from each other, thereby bowing the frame 34 and opening the pocket 28. In the preferred embodiment, the suspension assembly 10 is pretensioned so that a user need not stretch the suspension assembly 10 any further during installation between, for example, front and rear rails 16, 18. A user simply positions the front and rear ends 15, 17 on respective front and rear rails 16, 18 and secures the suspension assembly 10 into position with staples 12. Because a user need not stretch the suspension assembly 10 any further to secure it to the front and rear rails 16, 18, stress on the frame 14 is reduced and useful life of the frame 14 is increased.

Figure 5:
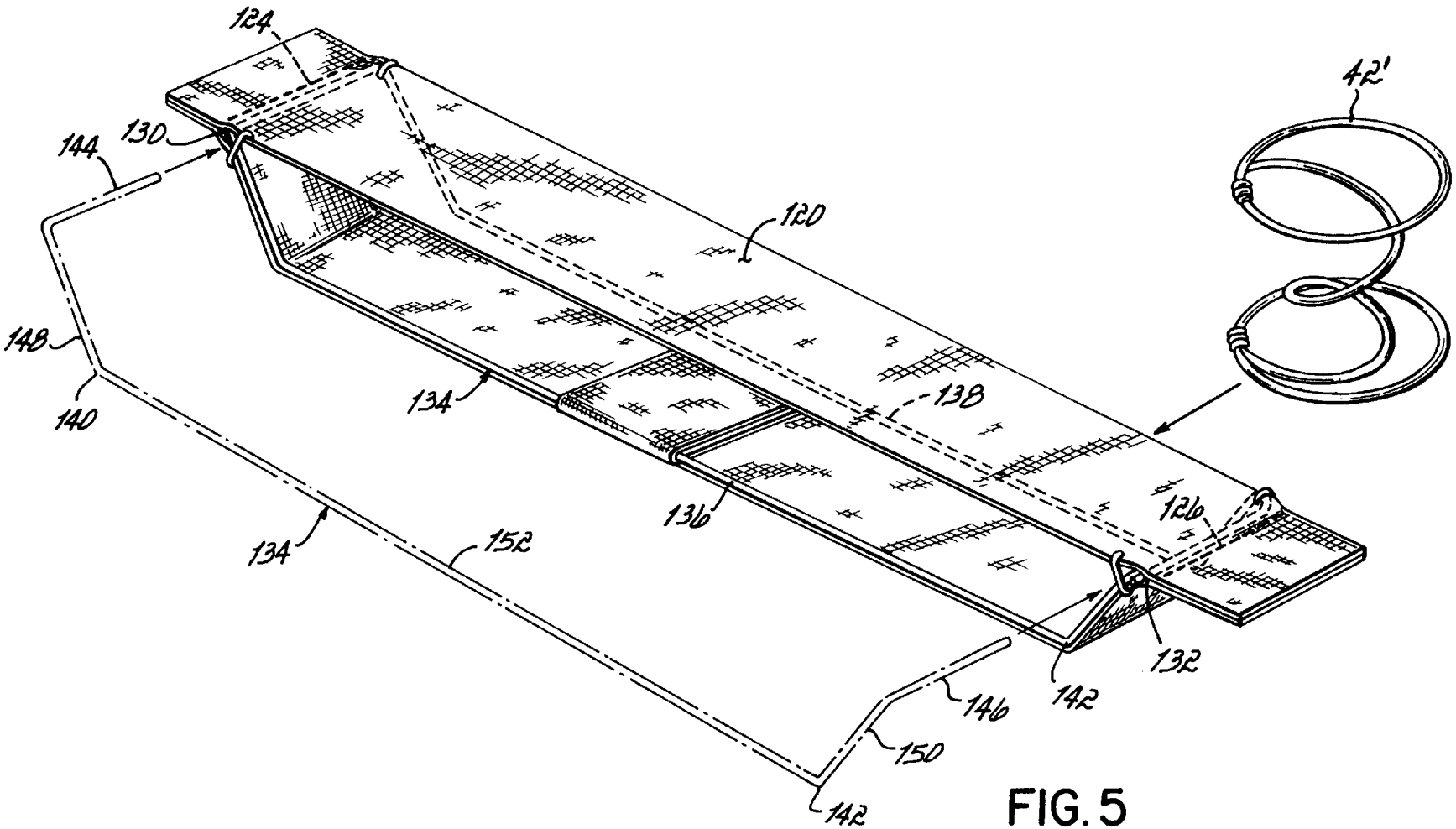
FIG. 5 is a partial exploded perspective view of an alternative suspension assembly of the present invention.
Figure 6:
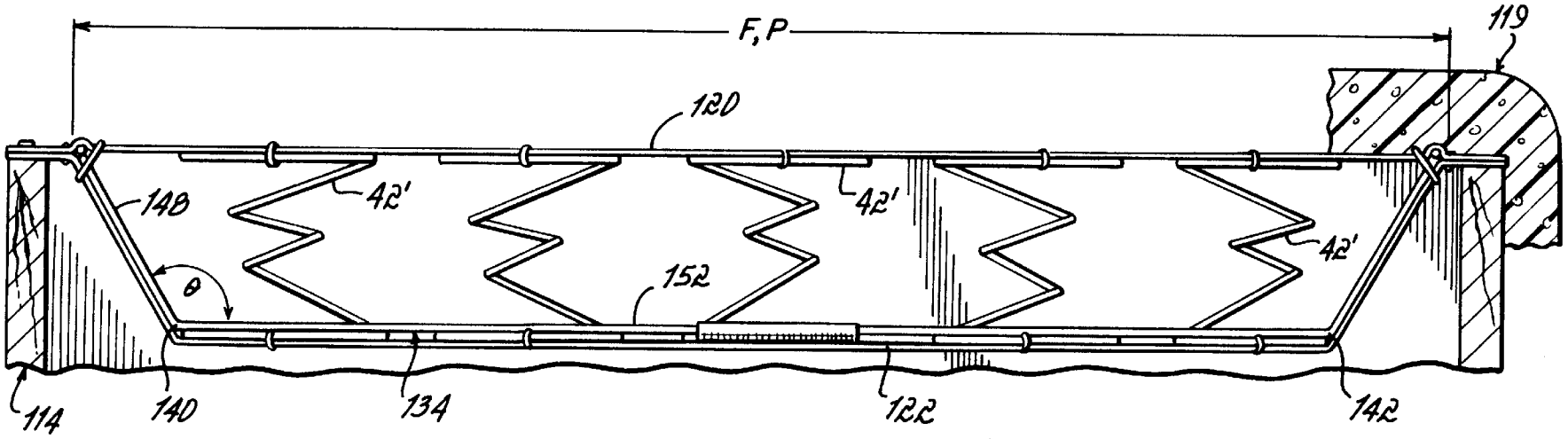
FIG. 6 is a cross-sectional view of the suspension assembly of FIG. 5 taken along lines 5—5.

As seen in FIGS. 5 and 6, a second preferred embodiment of a seat assembly 10*a* has a frame 134 with the same overall length F' as frame 34, but wire rods 136, 138 have bends 140, 142 spaced inwardly from ends 144, 146, which define bent portions 148, 150 and an unbent portion 152. The bends 140, 142 define an angle θ of about 60° between the unbent portion 152 and each bend portion 148, 150. It will be understood by those in the art that the distance the bends 140, 142 are spaced inwardly from the ends 144, 146 and the angle θ may be varied as desired in order to create a seating assembly 10*a* having varying comfort and configuration characteristics.

A top strap 120 and a bottom strap 122 are stitched together with lines of stitching 124, 126 to define a pocket 128 with a front and rear end crease 130, 132. Pocket 128 has a length P' measured from the front and crease 130 to the rear end crease 132 along the pocket's longitudinal extent. The length of the frame F' is substantially coextensive with the length of the pocket P'. The bottom strap 122 is longer than the top strap 120 so that when the frame 134 is inserted into the pocket 128 the pocket is continuously biased along its longitudinal extent towards the creases 130, 132 and the top strap 120 is continuously biased away from the bottom strap 122. Coil springs 42' are inserted into the pocket 128, the top strap 120 remains substantially flat as the frame 134 continually biases the pocket 128 both open downwardly away from the top strap 122 and towards the creases 130, 132 along the longitudinal extent of the pocket 128. By continually biasing the pocket 128 open downwardly, when the suspension assembly 10*a* is affixed at its front and rear ends 15, 17 to a seating frame 114, any padding 119 that is applied over the seating assembly 10*a* will not tend to bow upwardly or "smile" as will the padding 19 applied over the seat assembly 10, the top strap 22 bowing upwardly above front and rear rails 16, 18.

The frame 34 and the coil springs 42 are secured to the pocket 28 with fasteners, e.g., metal staples 44. In the preferred embodiment, the rectangular frame 34 is not secured directly to the coil springs 42, but it will be understood by those in the art that the frame 34 and the coil springs 42 may be secured to the pocket 28 as for example by metal hog rings.

An unexpected result from inserting the frame 34 into the pocket 28, when the frame 38 lies proximate the top or bottom strap 20, 22, the frame 34 reinforces one side of the seating assembly to a greater extent than the other. In the preferred embodiment, the frame 34 increases the bearing capacity of the suspension assembly by about 20% when the suspension assembly 10 is installed on a seating frame 14 so that the frame 34 is bowed upwardly rather than downwardly. This allows the suspension assembly 10 to be used for both softer applications, e.g., home use, and firmer applications, e.g., hotel use depending upon the orientation of the frame 34.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A suspension assembly for a seating frame comprising:

a top strap and a bottom strap secured thereto to define a pocket and opposing end creases, said pocket having a length located between said opposing end creases;

at least one resilient member placed in said pocket and biasing said top strap and said bottom strap away from each other; and a rigid frame placed in said pocket having a longitudinal dimension substantially equal to said pocket length, said rigid frame adapted to continually bias said end creases apart.

2. The suspension assembly of claim 1, said rigid frame comprising:

a generally rectangular wire frame.

3. The suspension assembly of claim 2 wherein said rectangular wire frame comprises:

a pair of metal bars; and a strap holding said bars in lateral fixed relation to each other.

4. The suspension assembly of claim 2, wherein said wire frame has at least one bend along its longitudinal dimension.

5. The suspension assembly of claim 2, wherein said wire frame has a pair of bends along its longitudinal dimension defining an unbent portion and a pair of bend portions.

6. The suspension assembly of claim 5, wherein each of said bends define an angle of about 60° between said unbent portion and each of said bend portions.

7. The suspension assembly of claim 1, comprising a plurality of fasteners affixing said frame to at least one of said top strap and said bottom strap.

8. The suspension assembly of claim 1 having front and rear ends, comprising a plurality of stitching lines securing said top strap to said bottom strap, wherein said stitching lines are spaced apart from each other to form said pocket therebetween, said stitching lines being spaced inwardly from the suspension assembly ends.

9. The suspension assembly of claim 1, wherein the distance measured along said top strap between said end creases is shorter than the distance measured along said bottom strap between said end creases.

10. A suspension assembly for a seating frame, comprising:

a top fabric strap and a bottom fabric strap secured thereto to define a pocket having a length and opposing end creases;

at least one resilient member placed in said pocket and biasing said top fabric strap away from said bottom fabric strap;

a pair of substantially rectangular metal bars placed in said pocket having a longitudinal dimension substantially equal to said pocket length; and a fabric strap holding said metal bars in lateral fixed relation to each other.

11. The suspension assembly of claim 10, wherein each of said metal bars has a pair of bends along their respective longitudinal dimensions defining an unbent portion and a pair of bend portions, each of said bends defining an angle of about 60° between said unbent portion and each of said bend portions.

12. The suspension assembly of claim 10, wherein the distance along said top strap between said end creases is less than the distance along said bottom strap between said end creases.

13. A suspension assembly for attachment to a seating frame, the seating frame having first and second spaced components, comprising:

a top fabric strap and a bottom fabric strap secured thereto to define a pocket having a length and opposing end creases, said top fabric strap and said bottom fabric strap having respective front and rear ends adjacent to but outboard of said pocket, said respective front and rear ends fastened to respective first and second spaced components so that the suspension assembly spans therebetween;

at least one resilient member placed in said pocket and biasing said top fabric strap away from said bottom fabric strap;

a pair of substantially rectangular metal bars placed in said pocket having a longitudinal dimension substantially equal to said pocket length; and a fabric strap holding said metal bars in lateral fixed relation to each other.

14. A suspension assembly for attachment to a seating frame, the seating frame having first and second spaced components, comprising:

a top fabric strap and a bottom fabric strap secured thereto to define a pocket having a length and opposing end creases, wherein the length of said top strap between said opposing end creases is less than the length of said bottom strap between said opposing end creases, said top fabric strap and said bottom fabric strap having respective front and rear ends adjacent to but outboard of said pocket, said respective front and rear ends fastened to respective first and second spaced components so that the suspension assembly spans therebetween;

at least one resilient member placed in said pocket and biasing said top fabric strap away from said bottom fabric strap;

a pair of substantially rectangular metal bars placed in said pocket having a longitudinal dimension substantially equal to said pocket length, wherein each of said metal bars has a pair of bends equally spaced inboard of the ends of said metal bars defining an unbent portion and a pair of bend portions, said bends defining an angle of about 60° between said unbent portion and said bend portions; and a fabric strap holding said metal bars in lateral fixed relation to each other.

15. A method of assembling a suspension assembly, comprising the steps of:

securing a top flexible strap to a bottom flexible strap together adjacent but spaced from the ends of said straps to form a pocket therebetween;

inserting a rigid frame into said pocket, said frame continually biasing said pocket along its longitudinal extent; and inserting at least one resilient member into said pocket, said resilient member urging said pocket open.

16. The method of claim 15, comprising the step of:

securing said frame to at least one of said top and top and bottom straps.

17. The method of claim 15, comprising the step of:

tying a pair of metal bars in fixed relation to each other to form said frame.

18. A method of assembling a seating assembly, comprising the steps of:

securing a top flexible strap to a bottom flexible strap together adjacent but spread apart from the ends of said straps to form a pocket therebetween;

inserting a rigid frame into said pocket, said frame continually biasing said pocket along its longitudinal extent;

inserting at least one resilient member into said pocket, said resilient member urging said pocket open; and fastening said ends of said straps to first and second spaced components so that said pocket is held in fixed relation therebetween.

* * * * *